US007021465B1

(12) United States Patent
McGuigan

(10) Patent No.: US 7,021,465 B1
(45) Date of Patent: Apr. 4, 2006

(54) SIMULATED WEDDING CAKE

(76) Inventor: Rosemarie E. McGuigan, 94 Manor Dr., Shirley, NY (US) 11967

( * ) Notice: Subject to any disclaimer, the term of this patent is extended or adjusted under 35 U.S.C. 154(b) by 70 days.

(21) Appl. No.: 10/830,938

(22) Filed: Apr. 23, 2004

(51) Int. Cl.
*B32B 1/02* (2006.01)

(52) U.S. Cl. ..... 206/457; 211/128.1; 428/7

(58) Field of Classification Search ..... 428/7, 428/98; 206/457; 211/128.1
See application file for complete search history.

(56) References Cited

U.S. PATENT DOCUMENTS 2,347,041 A 4/1944 Filsinger
3,843,220 A 10/1974 Snider
4,461,790 A 7/1984 Snider
5,413,801 A 5/1995 McLlwain
D419,438 S 1/2000 Gardner
6,374,755 B1 4/2002 Haase et al.

*Primary Examiner*—Alexander S. Thomas

(57) ABSTRACT

A simulated wedding cake includes a plurality of stackable layers oriented in a vertical manner. One of the plurality of layers defines a base and another of the plurality of layers defines an apex. The plurality of layers have apertures formed therein that are radially spaced about the respective perimeters thereof. The present invention further includes a plurality of capsules removably positionable in the plurality of apertures. Such a plurality of capsules can be filled with bird seed and confetti and may covered with a plurality of a tulles respectively.

18 Claims, 3 Drawing Sheets

SIMULATED WEDDING CAKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a simulated cake and, more particularly, to a simulated wedding cake for storing bird seed and confetti.

2. Prior Art

It has been a long held tradition to celebrate the marriage of people who have become wed. A typical wedding celebration, or party, might involve a gathering of the friends and relatives of the newly weds at which a wedding cake is served. The tradition of a wedding cake with the bride and groom ornament on top is a sight that virtually everyone has experienced. Family and friends of the newly weds, in particular, find wedding parties to be most exciting events and they thoroughly enjoy participating in the consumption of the wedding cake and throwing confetti or bird seed at the bride and groom.

The atmosphere of excitement may aggravate the difficulty of distributing confetti or birdseed to all the wedding attendees. Further, wedding cakes commonly served at wedding parties need to be properly portioned, cut and placed on plates requiring the effort of someone skilled with the hands, a facility which all the attendees do not usually possess. The cake itself can be difficult or time consuming to make, and the whole event might require considerable clean up when completed.

Accordingly, a need remains for a simulated wedding cake that overcomes the above-noted shortcomings.

BRIEF SUMMARY OF THE INVENTION

In view of the foregoing background, it is therefore an object of the present invention to provide a simulated wedding cake. These and other objects, features, and advantages of the invention are provided by a simulated wedding cake including a plurality of stackable layers, having preferably annular shapes, oriented in a substantially vertical manner. One of the plurality of layers defines the base and another of the plurality of layers defines the apex of the cake. The base layer preferably has a diameter larger than a diameter of the apex layer.

The plurality of layers preferably have a centrally disposed longitudinal axis extending therethrough and further have top and bottom surfaces disposed thereabout. The plurality of layers further have a plurality of apertures, with preferably annular shapes, formed therein and extending downwardly from the plurality of top surfaces. Such a plurality of apertures may terminate above the plurality of bottom surfaces, and are preferably spaced radially about a perimeter thereof.

The simulated cake further includes a plurality of capsules that have a top opening for selectively receiving a variable quantity of bird seed and confetti therein, for example. Such a plurality of capsules are removably positionable into the plurality of holes. The present invention may further include a plurality of tulles engageable about the plurality of capsules. A plurality of ribbons also may be attachable to the plurality of tulles for tying the respective top portions thereof. Advantageously, bird seed and confetti may be selectively contained therein until a user desires to sprinkle same over the bride and groom. The present invention may further include a plurality of rings engaged with the plurality of ribbons respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
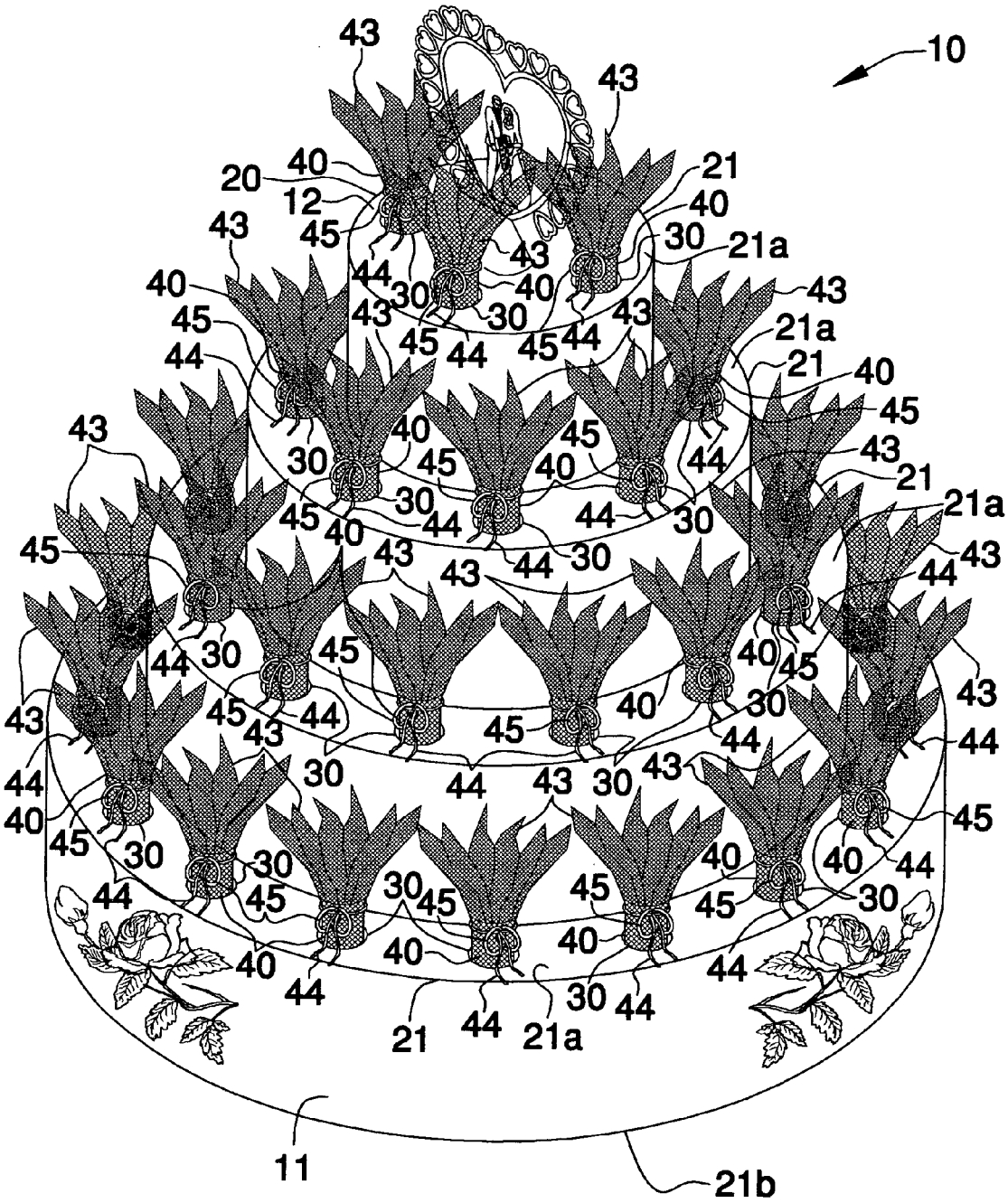
FIG. 1 is a perspective view showing a simulated wedding cake, in accordance with the present invention.
Figure 2:
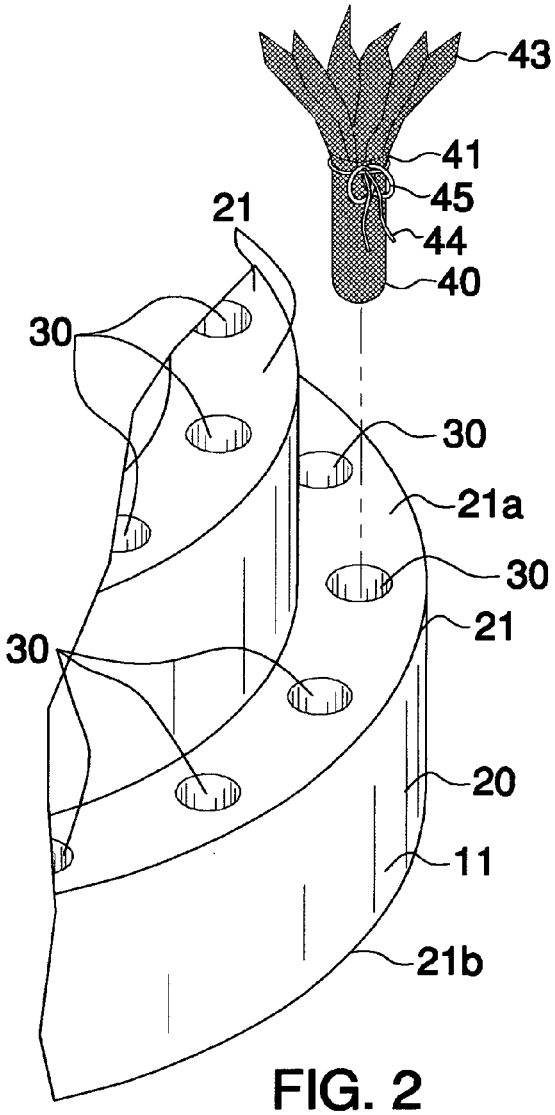
FIG. 2 is a partial, enlarged perspective view of FIG. 1 showing the aperture and capsule arrangement.
Figure 3:
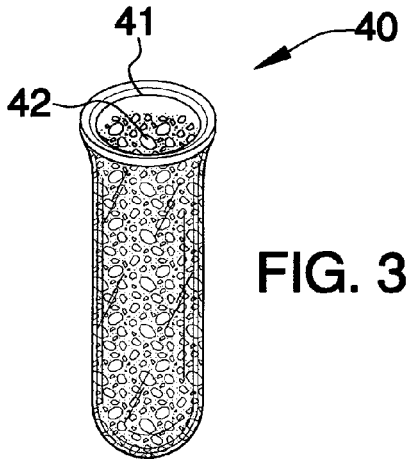
FIG. 3 is an enlarged perspective view of a capsule shown in FIG. 1.
Figure 4:
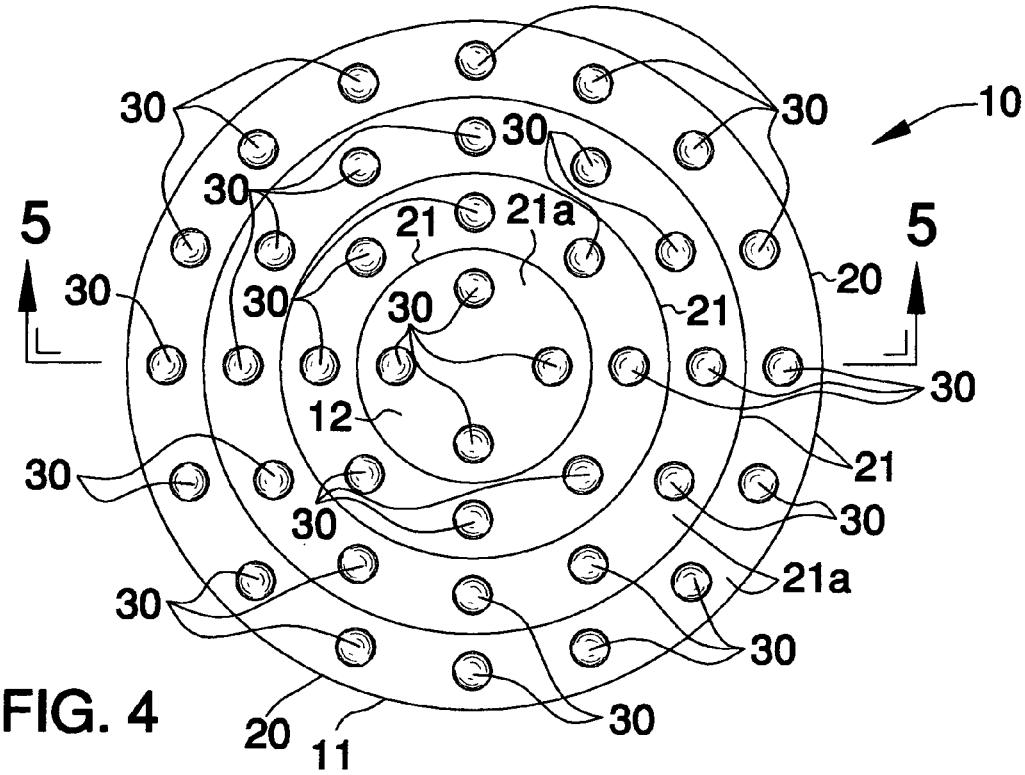
FIG. 4 is a top plan view of FIG. 1.
Figure 5:
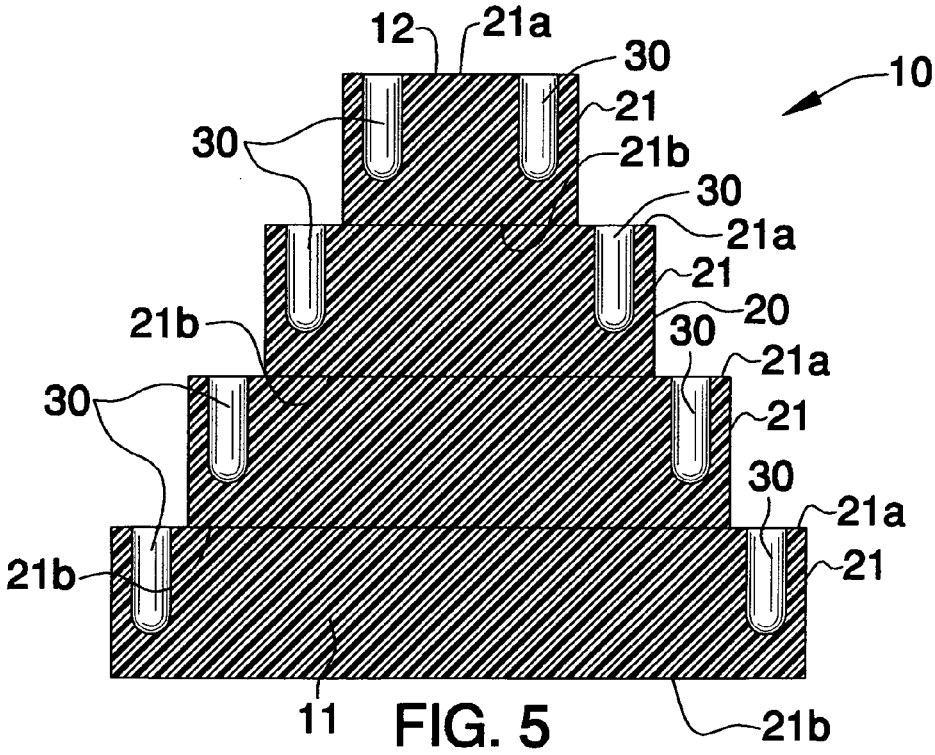
FIG. 5 is a cross-sectional view of the simulated cake shown in FIG. 4, taken along line 5—5.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–5 by the reference numeral 10 and is intended to provide a simulated wedding cake. It should be understood that the apparatus 10 may be used for various social engagements and therefore should not be construed to have limited applicability to only weddings.

Referring initially to FIG. 1, the assembly 10 includes a simulated wedding cake 20 including a plurality of stackable layers 21, having annular shapes, oriented in a substantially vertical manner. One of the plurality of layers 21 defines the base 11 and another of the plurality of layers 21 defines the apex 12 of the cake 20. The base layer 11 preferably has a diameter larger than a diameter of the apex layer 12.

The plurality of layers 21 have a centrally disposed longitudinal axis extending therethrough and further have top 21*a* and bottom 21*b* surfaces disposed thereabout. The plurality of layers 21 further have a plurality of apertures 30, with annular shapes, formed therein and extending downwardly from the plurality of top surfaces 21*a*. Such a plurality of apertures 30 terminate above the plurality of bottom surfaces 21*b*, and are preferably spaced radially about a perimeter thereof.

The simulated cake 20 further includes a plurality of capsules 40 that have a top opening 41 for selectively receiving a variable quantity of bird seed and confetti 42 therein, for example. Such a plurality of capsules 40 are removably positionable into the plurality of holes 30. The present invention further includes a plurality of tulles 43 engageable about the plurality of capsules 40. A plurality of ribbons 44 are also attachable to the plurality of tulles 43 for tying the respective top portions 41 thereof. Advantageously, bird seed and confetti 42 may be selectively contained therein until a user desires to sprinkle same over the bride and groom. The present invention further includes a plurality of rings 45 engaged with the plurality of ribbons 44 respectively.

The appealing features of the apparatus 10 are its novel and attractive appearance, practicality, and reasonable price. This apparatus 10 provides a breathtaking means to store bird seed and confetti 42 while resembling a wedding cake 20. Thus the apparatus 10 could garner a great deal of attention at a church or another location and would be quite a conversation piece. The apparatus 10 may also provide a practical and convenient location to house the capsules 40 filled with bird seed and confetti 42, that are to be showered over the bride and groom.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A simulated wedding cake comprising:

a plurality of stackable layers oriented in a substantially vertical manner, one said plurality of layers defining a base and other said plurality of layers defining an apex, said plurality of layers having a centrally disposed longitudinal axis extending therethrough and further has top and bottom surfaces disposed thereabout, said plurality of layers further having a plurality of apertures formed therein and radially spaced about a perimeter thereof respectively; and a plurality of capsules having a top opening for selectively receiving a predetermined quantity of bird seed and confetti therein and being removably positionable into said plurality of apertures.

2. The simulated wedding cake of claim 1, further comprising:

a plurality of tulles engageable about said plurality of capsules and for maintaining bird seed and confetti therein.

3. The simulated wedding cake of claim 1, further comprising:

a plurality of ribbons attachable to said plurality of tulles and for tying a top portion thereof.

4. The simulated wedding cake of claim 1, further comprising:

a plurality of rings engageable with said plurality of ribbons.

5. The simulated wedding cake of claim 1, wherein said plurality of aperture have substantially annular shapes.

6. The simulated wedding cake of claim 1, wherein said plurality of layers have substantially annular shapes, said base having a diameter larger than a diameter of said apex.

7. The simulated wedding cake of claim 1, wherein said plurality of apertures extend downwardly from said plurality of top surfaces and terminate above said plurality of bottom surfaces respectively.

8. A simulated wedding cake comprising:

a plurality of stackable layers oriented in a substantially vertical manner, one said plurality of layers defining a base and other said plurality of layers defining an apex, said plurality of layers having a centrally disposed longitudinal axis extending therethrough and further has top and bottom surfaces disposed thereabout, said plurality of layers further having a plurality of apertures formed therein and radially spaced about a perimeter thereof respectively;

a plurality of capsules having a top opening for selectively receiving a predetermined quantity of bird seed and confetti therein and being removably positionable into said plurality of apertures; and a plurality of tulles engageable about said plurality of capsules and for maintaining bird seed and confetti therein.

9. The simulated wedding cake of claim 8, further comprising:

a plurality of ribbons attachable to said plurality of tulles and for tying a top portion thereof.

10. The simulated wedding cake of claim 8, further comprising:

a plurality of rings engageable with said plurality of ribbons.

11. The simulated wedding cake of claim 8, wherein said plurality of aperture have substantially annular shapes.

12. The simulated wedding cake of claim 8, wherein said plurality of layers have substantially annular shapes, said base having a diameter larger than a diameter of said apex.

13. The simulated wedding cake of claim 8, wherein said plurality of apertures extend downwardly from said plurality of top surfaces and terminate above said plurality of bottom surfaces respectively.

14. A simulated wedding cake comprising:

a plurality of stackable layers oriented in a substantially vertical manner, one said plurality of layers defining a base and other said plurality of layers defining an apex, said plurality of layers having a centrally disposed longitudinal axis extending therethrough and further has top and bottom surfaces disposed thereabout, said plurality of layers further having a plurality of apertures formed therein and radially spaced about a perimeter thereof respectively;

a plurality of capsules having a top opening for selectively receiving a predetermined quantity of bird seed and confetti therein and being removably positionable into said plurality of apertures;

a plurality of tulles engageable about said plurality of capsules and for maintaining bird seed and confetti therein; and a plurality of ribbons attachable to said plurality of tulles and for tying a top portion thereof.

15. The simulated wedding cake of claim 14, further comprising:

a plurality of rings engageable with said plurality of ribbons.

16. The simulated wedding cake of claim 14, wherein said plurality of aperture have substantially annular shapes.

17. The simulated wedding cake of claim 14, wherein said plurality of layers have substantially annular shapes, said base having a diameter larger than a diameter of said apex.

18. The simulated wedding cake of claim 14, wherein said plurality of apertures extend downwardly from said plurality of top surfaces and terminate above said plurality of bottom surfaces respectively.

* * * * *